US010894338B2

(12) United States Patent
Ten Houten et al.

(10) Patent No.: US 10,894,338 B2
(45) Date of Patent: Jan. 19, 2021

(54) METHOD FOR THE PRODUCTION OF ARTIFICIAL WOOD BOARD

(71) Applicant: GoodHout Holding B.V., Delft (NL)

(72) Inventors: Silvia Ten Houten, Amsterdam (NL); Nicola Donato, Eindhoven (NL); Gianmarco Marino, Rome (IT)

(73) Assignee: GoodHout Holding B.V., Delft (NL)

( * ) Notice: Subject to any disclaimer, the term of this patent is extended or adjusted under 35 U.S.C. 154(b) by 0 days.

(21) Appl. No.: 16/065,545

(22) PCT Filed: Dec. 23, 2015

(86) PCT No.: PCT/EP2015/081163
§ 371 (c)(1),
(2) Date: Jun. 22, 2018

(87) PCT Pub. No.: WO2017/108130
PCT Pub. Date: Jun. 29, 2017

(65) Prior Publication Data
US 2020/0139577 A1 May 7, 2020

(51) Int. Cl.

| | |
|---|---|
| ***B27N 3/04*** | (2006.01) |
| ***B27N 1/00*** | (2006.01) |
| ***B27N 3/02*** | (2006.01) |
| ***B27N 3/08*** | (2006.01) |
| ***B27N 7/00*** | (2006.01) |
| ***D21H 11/12*** | (2006.01) |
| ***D21J 1/04*** | (2006.01) |

(52) U.S. Cl.
CPC ..... *B27N 3/04* (2013.01); *B27N 1/006* (2013.01); *B27N 3/02* (2013.01); *B27N 3/08* (2013.01); *B27N 7/00* (2013.01); *D21H 11/12* (2013.01); *D21J 1/04* (2013.01)

(58) Field of Classification Search
CPC . B27N 3/00; B27N 3/002; B27N 3/02; B27N 3/04; B27N 1/006; B27N 1/02; B27N 3/007; B27N 3/08; B27N 7/00; B27N 3/10; B27N 3/12; B27N 3/18; B27N 3/20; B29C 43/14; B29C 43/20; B29C 2043/147; D21F 13/00; D21F 13/10; D21J 1/00; D21J 1/04; D21J 3/00; D21H 11/12; Y10T 428/249921; B22F 2998/00; C08G 18/6492; C08L 97/02
See application file for complete search history.

(56) References Cited

U.S. PATENT DOCUMENTS

| | | | | |
|---|---|---|---|---|
| 3,021,244 | A * | 2/1962 | Meiler | D21J 1/00 156/62.2 |
| 3,116,200 | A * | 12/1963 | Young | C08L 89/06 162/151 |
| 3,880,975 | A * | 4/1975 | Lundmark | B27N 3/08 264/119 |
| 4,751,034 | A * | 6/1988 | DeLong | B27N 3/00 162/21 |
| 5,134,023 | A * | 7/1992 | Hsu | B27N 3/007 264/109 |
| 6,599,455 | B2 * | 7/2003 | Wierer | B27N 3/00 264/109 |
| 10,590,648 | B2 * | 3/2020 | Tebb | E04F 15/042 |
| 2012/0193828 | A1 * | 8/2012 | Chen | B29C 43/14 264/129 |
| 2013/0017359 | A1 * | 1/2013 | Selley | C08L 97/02 428/106 |
| 2013/0199743 | A1 * | 8/2013 | Lee | D21J 1/04 162/149 |
| 2016/0257815 | A1 * | 9/2016 | Varnell | C08L 97/02 |
| 2018/0223529 | A1 * | 8/2018 | Tebb | E04F 15/043 |
| 2020/0139577 | A1 * | 5/2020 | Ten Houten | B27N 1/006 |

FOREIGN PATENT DOCUMENTS

| | | | | |
|---|---|---|---|---|
| CN | 103128826 | B | 4/2015 | |
| EP | 1185587 | B1 | 2/2003 | |
| GB | 811533 | A | 4/1959 | |
| WO | WO-2017108130 | A1 * | 6/2017 | B27N 1/006 |

OTHER PUBLICATIONS

Celso et al., in "Binderless Fiberboards Made from Unripe Coconut HusksBinderless Fiberboards Made from Unripe Coconut Husks" Waste Biomass Valor pp. 1-10 (Year: 2017).*

Snijder et al., Coir Based Building and Packaging Materials, Final report of Project CFC/FIGHF/11, Dec. 31, 2005, pp. 1-121.

Glowacki et al., The Use of Coconut Husk in High Pressure Laminate Production, Journal of Tropical Forest Science; Jan. 2012, 24(1):27-36.

Van Dam et al., Process for production of high density/high performance binderless boards from whole coconut husk, Industrial Crops and Products, vol. 20, No. 1, Jul. 1, 2004, pp. 97-101.

Hidayat et al., Preparation and properties of binderless boards from Jatropha curcas L. seed cake, Industrial Crops and Products, vol. 52, Dec. 31, 2014, pp. 245-254.

* cited by examiner

*Primary Examiner* — Jose A Fortuna
(74) *Attorney, Agent, or Firm* — Michael J. Blessent; Bret E. Field; Bozicevic, Field & Francis LLP

(57) ABSTRACT

The present invention relates to a method for the production of artificial wood board. More specifically, present invention relates to a method for the production of highly durable, low cost, environmental friendly artificial wood board. Furthermore the present invention relates to artificial wood boards obtainable by the methods of present invention.

12 Claims, No Drawings

METHOD FOR THE PRODUCTION OF ARTIFICIAL WOOD BOARD

The present invention relates to a method for the production of artificial wood board. Furthermore the present invention relates to artificial wood boards obtainable by the methods of present invention.

In general, artificial wood board, also known as particleboards or fibreboards, are engineered panel products manufactured from wood particles e.g. wood chips, sawmill shavings, sawdust and fibres such as hemp, kenaf, jute, cereal straw. These wood particles are typically pressed and bonded together using a chemical binder. There are several types of artificial wood board, differing in density of the board; particle board (low-density), medium-density fibreboard also known as MDF, and hardboard. These wood boards, particularly MDF, is often used in the building and furniture industry.

The process to make wood board consists of binding fibres together with a binder, and pressing them into the final product. Firstly the raw material to be used is milled into particles or fibres, followed by drying of the particles. Then, resin or binder is sprayed onto the particles to obtain a mixture of particles and the binder. The binder is used to bond or "glue" the particles together to produce the end product, the wood board. Next, the mixture is made into a sheet, followed by compression of the mixture at between 20 and 30 bar and temperatures between 140 and 220° C. This process sets and hardens the glue (binder) and bonds the particles/fibres of the material. Finally, the boards are cooled and can be trimmed and sanded and are ready for use.

The binder is typically a thermosetting or heat-curing resin often made from toxic formaldehydes. The type of binder being used plays an important role in determining the characteristics of the end product Amino-formaldehyde based resins are the best performing when considering cost and ease of use. Urea phenolic formaldehyde resins and urea melamine resins are used to offer moist resistance with increased melamine offering enhanced resistance of the wood board. Generally, in the process of producing the wood boards, the fibres are bonded with urea-formaldehyde (UF) and phenol-formaldehyde (PF) resins due to the low cost and the effective physical-mechanical properties they give to the final product. For instance, UF resins are dominantly used in the MDF industry because of their low cost and fast curing characteristics.

Drawback of the use of UF and PF resins in the production of wood boards is that these resins are neither eco-friendly nor safe to use due to the health effects of exposure to formaldehyde emissions and the potential problems associated with formaldehyde emission. PF resins are more durable and do not emit formaldehyde, but the use of PF resins come with higher costs as compared to UF resins and PF resins have a much slower curing rate than UF resins. Furthermore, formaldehyde-based resins derived from petrochemicals processes that are not sustainable at all. A disadvantage of current wood boards is that they are very prone to expansion and discoloration due to moisture exposure. Wood boards are therefore not suitable for construction in a moist environment and are rarely used outdoors or in places where there are high levels of moisture.

The rapid urbanization is creating a shortfall of conventional building construction materials due to limited availability of natural resources. On the other hand energy consumed for the production of conventional building construction materials pollutes air, water and land. In order to meet the ever increasing demand for the energy efficient building construction materials there is a need to adopt cost effective, environmentally appropriate "green" technologies and redevelop traditional techniques.

Considering the above, there is a need in the art for a method for the production of highly durable, low cost, environmental friendly artificial wood board. This method should preferably result in a cost-effective and non-polluting production of high quality artificial wood boards, without the use of additional chemical binders.

It is an object of the present invention, amongst other objects, to address the above need in the art. The object of present invention, amongst other objects, is met by the present invention as outlined in the appended claims.

Specifically, the above object, amongst other objects, is met, according to a first aspect, by the present invention by a method for the production of artificial wood board, wherein the method comprises the following steps;

a) milling of lignin containing plant material to obtain a milled mixture;
b) conditioning of said milled mixture to obtain an equilibrium moisture content of between 12% to 25%, preferably of between 16% to 25%;
c) homogenising of said conditioned milled mixture;
d) cold-pressing of the homogenous mixture obtained in step c to obtain a brittle board;
e) hot-pressing of said brittle board to reach a density of between 1.2 to 1.4 g/cm$^3$ to obtain an artificial wood board.

Artificial wood board of present invention is produced from lignin containing plant material, which is considered to be a "green" raw material. The lignin content of this material is naturally present at high levels in specific plant materials. The binding agent used in the method of present invention is an all-natural product with no added formaldehydes or other non-natural chemical binders.

Lignin is a class of complex organic polymers and is a main component in the support tissues of vascular plants and algae. The lignin in the lignin containing plant material, when heated under high pressure, crosslinks into a thermosetting phenolic resin. This allows for the production of organic particle boards, without the addition of a binder. The phenol molecules in the lignin portion of the plant material have sufficient double covalent bonds and associated chemical reactivity to behave as a thermosetting resin, allowing the plant material to be hot pressed into high quality artificial wood board. The mechanical properties of the artificial wood are controlled by the degree of cross-linking of the lignin and density of the material. The degree of cross-linking density depends on the temperature, pressure during hot pressing and moisture content of the milled mixture used in the production process of the artificial wood board. An increase in the degree of cross-linking will lead to increased mechanical properties.

According to a preferred embodiment, the present invention relates to the method for the production of artificial wood board, wherein the lignin containing plant material comprises particles with a particle size of less than 5 mm, preferably less than 2.5 mm, more preferably less than 2 mm.

According to another preferred embodiment, the present invention relates to the method for the production of artificial wood board, wherein the lignin containing plant material comprises coconut husk pith. Coconut husk represents a good waste material suitable to produce wood boards. The lignin content of Coconut husk pith is naturally present at high levels; the lignin content in the pith ranges from 40% to 50%, whereas in the fibre from 30% to 35%. The coconut husk pith is inexpensive, moth proof, resistant to fungi and rot, flame retardant, and has excellent temperature and sound insulation properties. Coconut husk pith has high lignin and phenolic content and can be hot-pressed into artificial wood board, wherein no artificial binder has been added during the production. The naturally occurring chemicals in the husk pith allow it to be hot pressed into a binderless artificial wood board.

According to yet another preferred embodiment, the present invention relates to the method for the production of artificial wood board, wherein the lignin containing plant material comprises fresh plant material of less than 6 months old. The peculiar lignin in the plant material plays an important role in the curing of the artificial wood boards. Too dry raw material looses the phenolic resin behaviour that gives the thermosetting properties to the final boards.

According to a preferred embodiment, the present invention relates to the method for the production of artificial wood board, wherein the lignin containing plant material comprises a moisture content of between 12% to 25%, preferably of between 16% to 25%. The moisture content has several effects during the production of the artificial wood board. The curing process at ~12% moisture content resulted in too dry boards with more non-cured material than the boards produced at ~16% moisture content of the lignin containing plant material. However, too high moisture content causes blistering from rapid moisture vaporization and limits the density that can be achieved during hot pressing of the brittle board. This is probably due to excessive physical particle displacement by the excess water present in the brittle board. On the other hand, too low moisture content inhibits viscoplastic flow of the particles during hot pressing, limiting the density due to lack of proximity between the reacting molecules resulting in a lower degree of cross-linking A moisture content of between 16% to 25% in the lignin containing plant material showed the highest quality of artificial wood board in respect to the highest density, the best flexural modulus and strength. The moisture content of the raw material is directly related with the timing chosen and the thickness to be produced. High moisture content ensures higher conductivity and therefore shortens the time required for the sample to reach the set temperature. However, high moisture can lead to steam explosions during pressure relief and create inhomogeneity that ultimately affects the final properties of the material.

According to another preferred embodiment, the present invention relates to the method for the production of artificial wood board, wherein the equilibrium moisture content is adjusted by the addition of water to the milled mixture to obtain the equilibrium moisture content.

According to yet another preferred embodiment, the present invention relates to the method for the production of artificial wood board, wherein step e is followed by conditioning the artificial wood board under static pressure for at least 24 hours to obtain a form-stable artificial wood board. The wood boards are susceptible to deformation caused by water up-take during the recondition. Therefore, the wood boards are kept under a static mass using a static load horizontal wise directly after the hot pressing. In this way the boards will become form-stable.

According to a preferred embodiment, the present invention relates to the method for the production of artificial wood board, wherein in step d said homogenous mixture is cold pressed to obtain a brittle board with a thickness of at least 1:3, preferably at least 1:4, more preferably at least 1:5, most preferably at least 1:6, when compared to the thickness of the material before cold pressing. The homogenous mixture before being cold pressed has a density of between 0.1-0.25 g/cm$^3$, preferably ~0.2 g/cm$^3$. After cold pressing, the brittle board has a density of between 0.3-0.6 g/cm$^3$, preferably between 0.35-0.45 g/cm$^3$.

According to the present invention relating to the method for the production of artificial wood board, wherein step e is performed in total in at most 1 to 4 minutes per 1 mm layer thickness of said brittle board, preferably 1 to 3 minutes per 1 mm layer thickness of said brittle board, more preferably 1.5 to 2 minutes per 1 mm layer thickness of said brittle board. The timing of step e affects the balance between a matrix that is drying out its water content by evaporation, the time required for the reaction to be completed and the cooling time for the material to be homogeneously cooled down.

According to yet another preferred embodiment, the present invention relates to a method wherein step e is performed at a temperature of between 140° C. to 220° C., preferably 150° C. to 200° C., more preferably 160° C. to 180° C. The temperature is an essential variable in hot pressing in order to achieve the optimal flow and chemical crosslinking of the particles. The temperature of the brittle board must exceed 140° C. for crosslinking to occur; lignin reacts (or cures) above 140° C. to chemically bond with the organic compounds that lignin is surrounded by. However to minimize time in the hot press and to speed up the process, temperatures of 160° C. to 180° C. are preferred. Using a temperature higher than 220° C. will risk damaging the finish of the artificial wood board due to blistering or charring. The temperature also affects the viscosity of the lignin, reducing the viscosity, making it possible for it to flow through the porous media and homogenously bind to the fibres.

According to present invention relating to the method for the production of artificial wood board, wherein step e is performed at a pressure of 120 to 170 bars, preferably 130 to 160 bars, most preferably 140 to 150 bars. This pressure is required to hold the particles of the brittle board in close enough proximity that the phenol molecules can bond and are "glued" together. The pressure is the main driver for the lignin to flow and fill all the cavities, as well as bring in close contact the lignin and the matrix. The latter of the two facilitates the creation of more cross-linking points therefore the bonding and the strength of the material. The most optimal pressure selected is the result of two phenomena playing an important role: the first is the high viscosity of the lignin that has to flow through very narrow channels of the matrix increasing the pressure drop; the second is the short distance between lignin and fibres required to ensure reaction and therefore strength of the final product.

According to another preferred embodiment, present invention relates to the method according to present invention, wherein said conditioned milled mixture obtained in step b is mixed with other wood like materials and/or additives and/or polymers and/or cement-based compositions. In order to obtain improved properties of the product (such as water-resistant, fire resistant, mould resistant, etc., or a different finish such as a matt or gloss look) and to develop an even more sustainable product several natural and chemical additives can be added to the milled mixture, such as wheat gluten, soy protein, milk casein, vegetable oil, citric acid, furfural, wax, dyes, wetting agents and/or release agents.

The present invention, according to a second aspect, relates to an artificial wood board obtainable by the methods of present invention.

According to yet another preferred embodiment of present invention, the artificial wood board has a bending strength of at least 46 N/mm$^2$, preferably at least 47 N/mm$^2$. The mixture of particles obtained from milling of lignin containing plant material has short fibres incorporated in the mixture. These fibres affect the flexural strength of the artificial wood board. The flexural stiffness is the best indicator of the quality of processing of the lignin containing plant material.

According to the present invention, the artificial wood board has a moisture content of between 12% to 25%, preferably of between 16% to 25% and the artificial wood board according to present invention has a thickness swelling of at most 13%, preferably at most 12%, more preferably at most 10%, most preferably at most 9% due to moist absorption after immersion in a aqueous solution for 24 hours according to European Standard EN 317. The artificial wood board has a high resistance to the water uptake.

According to another preferred embodiment of the present invention the artificial wood board has an internal bond strength of at least 1.8 N/mm$^2$, preferably at least 2.2 N/mm$^2$, more preferably at least 2.5 N/mm$^2$ and the artificial wood board comprises at least 25% to 50% v/v of coir dust.

When compared to the High Density Fibreboards (HDF), also called Hardboards (HB), the artificial wood board of present inventions has improved characteristics. The artificial wood board of present invention is in compliance with the European Standard EN622-2 and belongs to the class: "Hardboard for load bearing and humid conditions" (type HB.HLA1).

According to yet another preferred embodiment of present invention the artificial wood board comprises a composition comprising lignin containing plant material mixed with other wood like materials, additives and/or polymers and/or cement-based compositions. Artificial wood boards of present invention can be developed with the addition of several natural and chemical additives, such as wheat gluten, soy protein, milk casein, vegetable oil, citric acid and/or furfural in order to obtain better properties of the product and to develop an even more sustainable product. The artificial wood board of present invention can comprise various other chemicals including wax, dyes, wetting agents, release agents to obtain a product that is highly water resistant, fireproof, insect proof, etc.

The present invention will be further detailed in the following examples

Example 1 Milling

Fresh coconut husk (less than 6 months old) has been imported from Indonesia. This has been stored in plastic bags in a conditioned room at 95% relative humidity (RH) and 28° C. in order to maintain the freshness of the husk. Later, circa 2 kg of coconut husk has been sawed in smaller parts and milled with FRITSCH model 15.302/694 in three different steps (no sieve, 10 mm sieve, 2 mm sieve). The final result is a mix of fiber and dust sieved at 2 mm.

Example 2 Conditioning and Moisture Content

The milled coconut coir has been conditioned in two different climate rooms: RH 50% at 24° C. and RH 65% at 20° C. for a period of between 5 to 12 days, depending on the moisture content of the milled coconut coir. Next, the moisture content was determined weighing the wet sample, drying in oven at 103° C. for at least 18 hours and finally weighing the dry sample following the formula:

$$EMC = \frac{mw - md}{md} * 100$$

Wherein "mw" and "md" are respectively wet weight and dry weight.

Example 3 Production Wood Boards

The process comprises the steps:

1. Coir conditioning
2. Pre-pressing
3. Hot-Pressing
4. Conditioning under static pressure
5. Trimming
6. Board conditioning 1. Coir conditioning This step is performed until the target equilibrium moisture content (EMC) has been reached.

2. Pre-pressing

Conditioned coir is loaded in a mold in order to reach a final density of 1.35 g/cm$^3$. After having spread uniformly the coir, the mold has been pressed with 0.15 Tons/cm$^2$ for 1 minute. In this case 69.8 g of coir is loaded in a steel mold of 10×15 cm at 22.5 Tons for 1 minute.

3. Hot pressing

The result of the pre-pressing step is a brittle board called "Prepack". The produced "Prepacks" were put between two aluminum plates 1.6 mm thick and pressed at 170° C. at 22.5 Tons (0.15 Tons/cm$^2$) for 4 minutes, including the heating up time. Then, the sample was cooled down inside the press till an internal temperature of 50° C. was measured with a thermocouple.

4. First conditioning under static pressure

The produced boards were conditioned at room temperature under a mass overnight.

5. Trimming

Trimming of the sample was performed after the first conditioning and before the second conditioning step in order to eliminate the dry-non cured-material.

6. Second Conditioning

The trimmed samples were conditioned at 65% RH and 20° C. until the mass did not change more than 0.01% according to the European Standard EN 310, e.g. to obtain a form-stable product. The samples were put on supports with a mass on top of them in order to keep the flatness.

Example 4 Determine Physical-Mechanical Proprieties of the Artificial Wood Board Samples where cut after having reached a stable weigh in two squares 50×50 mm and one strip of 2×8 mm. The samples produced were tested according the European Standard EN 622-2. This standard includes all the tests required to compare the artificial wood board with High Density Fiberboards (HDF) also called Hardboards (HB). List of the specific tests is provided below.

TABLE 1

Tests according to European Standards performed on the artificial wood board.

| Test name | European Standard |
|---|---|
| Determination of the density | EN 322 |
| Swelling thickness after immersion in water 24 h | EN 317 |
| Bending strength, flexural modulus | EN 310 |
| Internal Bond | EN 319 |
| Internal Bond after boil test | EN 319 - EN1087-1 |

Results 11 samples of artificial wood board were tested according to European Standards as set out above. Samples 1 to 5, 10 and 11 have a moisture content of 16.4%, and samples 6 to 9 have a moisture content of 12%.

Density

Density measurements have been made according with European standard EN 322 in duplicate on samples 1, 2, 3, 4, 8, 9, 10 and 11.

TABLE 3

Density measurements of artificial wood board samples

| sample | weight (g) | height (mm) | width (mm) | thickness (mm) | density (g/cm$^3$) |
|---|---|---|---|---|---|
| 1.1 | 10.71 | 50.26 | 49.98 | 3.03 | 1.41 |
| 1.2 | 11.38 | 50.29 | 50.33 | 3.22 | 1.40 |
| 2.1 | 10.92 | 50.41 | 50.40 | 3.06 | 1.40 |
| 2.2 | 10.97 | 50.52 | 50.35 | 3.10 | 1.39 |
| 3.1 | 10.87 | 50.42 | 50.44 | 3.08 | 1.39 |
| 3.2 | 10.78 | 50.39 | 50.29 | 3.05 | 1.40 |
| 4.1 | 10.94 | 50.51 | 50.37 | 3.11 | 1.38 |
| 4.2 | 10.51 | 50.28 | 50.79 | 2.98 | 1.38 |
| 8.1 | 10.65 | 50.23 | 50.21 | 3.036 | 1.39 |
| 8.2 | 11.04 | 50.26 | 50.23 | 3.113 | 1.40 |
| 9.1 | 10.7 | 50.33 | 50.14 | 3.03 | 1.40 |
| 9.2 | 10.89 | 50.03 | 50.29 | 3.08 | 1.41 |
| 10.1 | 10.54 | 48.05 | 49.23 | 3.19 | 1.40 |
| 10.2 | 10.58 | 48.92 | 49.34 | 3.13 | 1.40 |
| 11.1 | 10.23 | 48.80 | 49.69 | 3.01 | 1.40 |
| 11.2 | 10.31 | 48.99 | 49.86 | 3.00 | 1.41 |
| Average | 10.863 | 50.328 | 50.318 | 3.073 | 1.40 |

Bending Strength and Flexural Modulus

Bending strength and flexural modulus test has been made on all the samples according European standard EN310.

TABLE 4

Bending strength and flexural modulus of artificial wood board samples.

| Sample | Bending Strength (N/mm$^2$) | Flexural modulus (N/mm$^2$) |
|---|---|---|
| 1.3 | 46.28 | 4156.44 |
| 2.3 | 46.37 | 4221.63 |
| 3.3 | 47.99 | 4217.41 |
| 4.3 | 45.68 | 6944.53 |
| 5.1 | 46.83 | 4409.03 |
| 5.2 | 46.22 | 4419.26 |
| Average 16.4% | 46.56 | 4728.05 |
| 6.1 | 47.85 | 4660.25 |
| 6.2 | 45.39 | 4601.92 |
| 6.3 | 46.54 | 4590.80 |
| 7.1 | 47.29 | 4387.31 |
| 7.2 | 38.89 | 3625.64 |
| 7.3 | 41.30 | 3757.09 |
| 8.3 | 39.26 | 3790.51 |
| 9.3 | 46.99 | 4233.77 |
| Average 12% | 44.19 | 4205.91 |

Internal bond and internal bond after boiling test

Internal bond and internal bond after boiling test was performed on samples 1 to 4 according to European Standard EN319 and EN1087-1.

TABLE 5

Internal bond and internal bond after boil test of artificial wood board samples.

| Sample | Strength (N/mm$^2$) | Sample after boil test | Strength (N/mm$^2$) |
|---|---|---|---|
| 1.1 | 2.61 | 1.2 | 2.03 |
| 2.1 | 1.69 | 2.2 | 1.64 |
| 3.1 | 2.15 | 3.2 | 1.21 |
| 4.1 | 3.96 | 4.2 | 1.59 |
| Average | 2.60 | | 1.61 |

Swelling in thickness after immersion in water 24 h

This test has been made on the following samples according the European Standard EN317.

TABLE 6

Swelling in thickness after immersion in water measurements

| Sample | weight (g) | Height (mm) | Width (mm) | Thickness (mm) | Swelling (%) |
|---|---|---|---|---|---|
| 8.1 | 11.77 | 50.88 | 50.94 | 3.413 | 12.4% |
| 8.2 | 12.10 | 50.87 | 50.81 | 3.505 | 12.6% |
| 9.1 | 11.86 | 50.98 | 50.82 | 3.417 | 12.8% |
| 9.2 | 11.96 | 50.76 | 50.91 | 3.465 | 12.5% |
| 10.1 | 11.49 | 48.64 | 49.84 | 3.485 | 9.1% |
| 10.2 | 11.48 | 49.49 | 50.02 | 3.482 | 11.1% |
| 11.1 | 11.24 | 49.51 | 50.24 | 3.382 | 12.5% |
| 11.2 | 11.32 | 49.68 | 50.56 | 3.382 | 12.6% |

The invention claimed is:

1. A method for the production of artificial wood board without the addition of a binder, wherein the method comprises the following steps:

a) milling of lignin containing plant material to obtain a milled mixture comprising particles with a particle size of less than 5 mm, wherein said lignin containing plant material comprises coconut husk pith;

b) conditioning said milled mixture at a RH of between 50%-65%, at a temperature of between 20-24° C. for a period of between 5 to 12 days to obtain a conditioned milled mixture having an equilibrium moisture content of between 16% to 25%;

c) homogenising said conditioned milled mixture to produce a homogenous mixture having a density of between 0.1-0.25 g/cm$^3$;

d) cold-pressing the homogenous mixture obtained in step c to obtain a brittle board having a density of between 0.3-0.6 g/cm$^3$; and e) hot-pressing said brittle board to reach a density of between 1.2 to 1.4 g/cm$^3$ to obtain an artificial wood board.

2. The method according to claim 1, wherein said lignin containing plant material comprises fresh plant material of less than 6 months old.

3. The method according to claim 1, wherein said equilibrium moisture content is adjusted by the addition of water to said milled mixture to obtain said equilibrium moisture content.

4. The method according to claim 1, wherein step e is followed by conditioning said artificial wood board under static pressure for at least 24 hours to obtain a form-stable artificial wood board.

5. The method according to claim 1, wherein in step d said homogenous mixture is cold pressed to obtain a brittle board with a thickness of at least 1:3 when compared to the thickness of the material before cold pressing.

6. The method according to claim 5, wherein the thickness is at least 1:6.

7. The method according to claim 1, wherein step e is performed in total in 1 to 4 minutes per 1 mm layer thickness of said brittle board.

8. The method according to claim 1, wherein step e is performed at a temperature of between 140° C. to 220° C.

9. The method according to claim 8, wherein step e is performed at a temperature of between 160° C. and 180° C.

10. The method according to claim 1, wherein step e is performed at a pressure of 120 to 170 bars.

11. The method according to claim 10, wherein step e is performed at a pressure of 140 to 150 bars.

12. The method according to claim 1, wherein the particle size is less than 2.5 mm.

* * * * *